US008037837B2

(12) United States Patent
La Violette et al.

(10) Patent No.: US 8,037,837 B2
(45) Date of Patent: Oct. 18, 2011

(54) FLOATING DOCK AND DOCK UNIT FOR MAKING SUCH

(75) Inventors: Éric La Violette, Sherbrooke (CA); Serge Lamoureux, Magog (CA); Alexandre Lamoureux, Magog (CA)

(73) Assignee: Candock Inc., Sherbrooke, QC (CA)

( * ) Notice: Subject to any disclaimer, the term of this patent is extended or adjusted under 35 U.S.C. 154(b) by 273 days.

(21) Appl. No.: 12/476,741

(22) Filed: Jun. 2, 2009

(65) Prior Publication Data

US 2010/0300345 A1 Dec. 2, 2010

(51) Int. Cl.
*B63B 35/44* (2006.01)
*B63C 1/02* (2006.01)

(52) U.S. Cl. ..... 114/263; 405/219

(58) Field of Classification Search ..... 114/263, 114/264, 267; 405/26, 219, 220
See application file for complete search history.

(56) References Cited

U.S. PATENT DOCUMENTS

| | | | |
|---|---|---|---|
| 3,073,274 | A | 1/1963 | Lamb |
| 3,191,565 | A | 6/1965 | Filak |
| 3,659,540 | A | 5/1972 | Toby et al. |
| 4,085,696 | A | 4/1978 | Shorter |
| 4,263,865 | A | 4/1981 | Shorter |
| 4,342,276 | A | 8/1982 | Sluys |
| 4,353,320 | A | 10/1982 | Sluys et al. |
| 4,470,365 | A | 9/1984 | Sluys et al. |
| RE32,229 | E | 8/1986 | Sluys et al. |
| 4,604,962 | A | 8/1986 | Guilbault |
| 5,183,001 | A | 2/1993 | Stranzinger |
| 5,251,560 | A | 10/1993 | Ban et al. |
| 5,682,833 | A | 11/1997 | Eva et al. |
| 5,690,523 | A | 11/1997 | Yu |
| 5,947,050 | A | 9/1999 | Eva et al. |
| 6,033,151 | A | 3/2000 | Tsou |
| 6,073,572 | A | 6/2000 | Gruhn et al. |
| 6,138,600 | A | 10/2000 | Berquist |
| 6,179,525 | B1 | 1/2001 | Gruhn et al. |
| 6,431,106 | B1 | 8/2002 | Eva et al. |
| 6,745,714 | B1 | 6/2004 | Faber |
| D508,453 | S | 8/2005 | Ahern |
| 7,069,872 | B2 | 7/2006 | Ostreng et al. |
| 7,117,809 | B2 | 10/2006 | Lamoureux et al. |
| 7,213,531 | B2 | 5/2007 | Ahern |
| 7,243,608 | B2 | 7/2007 | Knight et al. |
| 7,425,086 | B2 | 9/2008 | Murphy |
| 7,426,898 | B1 | 9/2008 | Ahern |
| 2004/0028478 | A1 | 2/2004 | Lektman |
| 2007/0245942 | A1 | 10/2007 | Sestito et al. |

OTHER PUBLICATIONS

Connect-A-Dock, undated, [online], [retrieved on Mar. 5, 2009]. Retrieved from the Internet <URL: http://www.connectadock.com/dock/2000series/2000accessories.asp, seven pages>.

EZ-Dock, undated, [online], [retrieved on Mar. 5, 2009]. Retrieved from the Internet <URL: http//www.ez-dock.com/content/view/83/184/lang.us, two pages>.

*Primary Examiner* — Lars A Olson
(74) *Attorney, Agent, or Firm* — Benoît & Côté

(57) ABSTRACT

The present document describes a dock unit attachable to another dock unit with a fastener for forming a floating dock. The dock unit comprises a floating body having a mating surface and an attachment adapted to receive the fastener. Thereby attaching the floating body is able to be attached to the other dock unit. The dock unit further comprises a cover for covering the mating surface, the cover having a contact surface adapted to contact the fastener. In use, the contact surface is positioned proximate the attachment so that, when the attachment receives the fastener, the contact surface is contacted by the fastener, thereby limiting the movement of the cover with respect to the floating body.

20 Claims, 16 Drawing Sheets

PRIOR ART

FLOATING DOCK AND DOCK UNIT FOR MAKING SUCH

TECHNICAL FIELD

This description relates to the field of floating docks. More particularly, this description relates to floating docks and to dock units for making such.

BACKGROUND OF THE INVENTION

Floating docks made from an assembly of similar dock units are well known. Each dock unit is typically made of a floating body, sometimes topped by a cover providing a walking surface. A passage between the cover and the floating body for different networks of cables or piping (i.e., under the floor of such floating docks) may be provided. Because the cover provides the walking surface, it is very important that it be securely attached to the floating body so that it does not shift position or rock when being walked upon, which could cause serious injuries to the person walking on the dock. Also, the attachments have to withstand efforts generated by accessories fixed to the cover, such as a base for delivering water or electricity, a mooring device, a fishing rod support, or a bench.

However, fixing the cover on the floating body proves not to be straightforward. Indeed, attachments should not substantially protrude too much from the walking surface so as to not cause a risk of tripping, while not being too recessed so as to accumulate water. Moreover, such attachments often comprise screws inserted in threaded receptacles integrated in the floating body. These threaded receptacles add complexity and cost in production today. Hence, such attachments often add costs, parts and complication to the dock.

There is therefore a need for improved dock units and for floating docks including such dock units.

SUMMARY OF THE INVENTION

It is an object of the present invention to provide a dock unit and a floating dock made of such dock units that overcomes or mitigates one or more disadvantages of known dock units and floating docks made of such dock units or at least provides a useful alternative.

According to an aspect of the invention, there is provided a dock unit attachable to another dock unit with a fastener for forming a floating dock. The dock unit comprises a floating body and a cover. The floating body has a mating surface and an attachment adapted to receive the fastener and thereby attaching the floating body to the other dock unit. The cover covers the mating surface. The cover has a contact surface adapted to contact the fastener. In use, the contact surface is positioned proximate the attachment so that, when the attachment receives the fastener, the contact surface is contacted by the fastener, thereby limiting the movement of the cover with respect to the floating body.

According to another aspect of the invention, there is provided a dock unit for a floating dock. The dock unit comprises a floating body and a cover. The floating body has a mating surface and at least three lateral body sides. The cover covers the mating surface. The cover has a top surface for forming a floor for the floating dock. The cover further has a protrusion for abutting against the mating surface and for supporting the top surface at a distance from the mating surface. Thereby a passage between the top surface and the mating surface is created, providing access to each of the three lateral body sides.

According to another aspect of the invention, there is provided a floating dock comprising a plurality of dock units and a plurality of fasteners. Each one of the plurality of dock units are attached to at least one other of the plurality of dock units with one of the plurality of fasteners. Thereby, a pair of corresponding floating bodies and a pair of a corresponding covers attached by the one of the plurality of fasteners are defined.

According to another aspect of the invention, there is provided a cover for covering a mating surface of a floating body assembled to another floating body with a fastener for forming a floating dock. The cover comprises four lateral cover sides defining four cover corners. The cover further comprises a top surface for forming the floor of the floating dock and four protrusions, each one of the four protrusions being operative to abut against the floating body for supporting the top surface at a distance from the floating body. Each one of the four protrusions are located at a different one of the four cover corners. Thereby, a passage between the top surface and the floating body is created, providing access to at least two of the four lateral cover sides. The cover further comprises four contact surfaces, each one of the four contact surfaces comprising a conical portion having a symmetry axis substantially normal to the top surface. Each one of the four contact surfaces are located at a different one of the four cover corners so that when the fastener attaches the floating body to the other floating body, one of the four contact surfaces is contacted by the fastener, thereby limiting the movement of the cover with respect to the floating body.

According to another aspect of the invention there is provided a kit for a floating dock. The kit comprises a plurality of fasteners, a plurality of floating bodies and a plurality of covers as previously defined. Each one of the plurality of floating bodies has a mating surface, four lateral body sides defining four body corners and four attachments. Each one of the four attachments is located at a different one of the four body corners and is adapted to receive one of the plurality of fasteners. Thereby, each one of the plurality of floating bodies is attached to another one of the plurality of floating bodies.

BRIEF DESCRIPTION OF THE DRAWINGS

Further features and advantages of the present invention will become apparent from the following detailed description, taken in combination with the appended drawings, in which.

It will be noted that throughout the appended drawings, like features are identified by like reference numerals.

DETAILED DESCRIPTION

Figure 1:
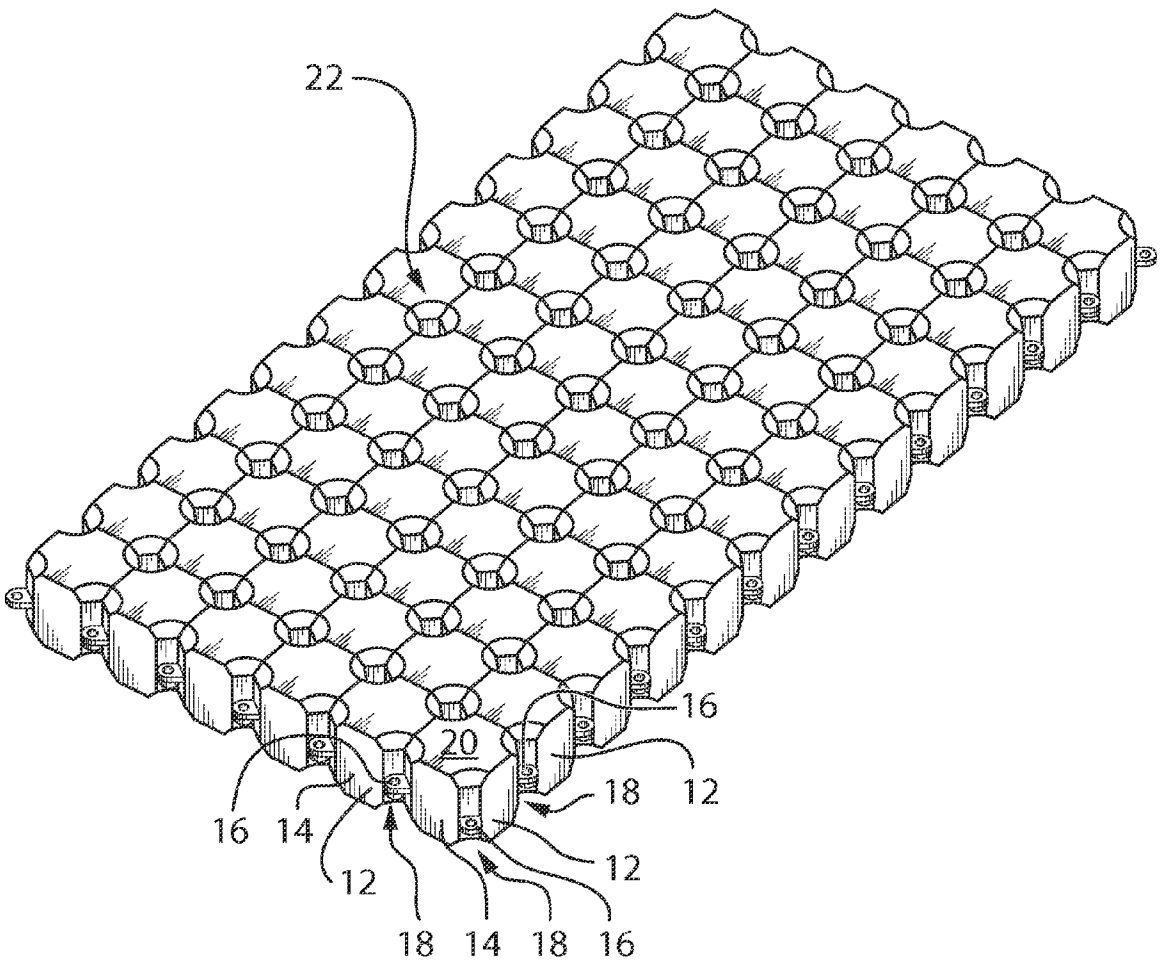
FIG. 1 is an axonometric view of a floating dock, in accordance with the prior art.

Referring to the drawings, and more particularly to FIG. 1 which shows a floating dock 10 according to the prior art. The floating dock 10 consists of several columns and rows of dock units 12 attachable to one another. Each dock unit 12 comprises a floating body 14 having an attachment 16 located at each body corner 18. At each location where at least two attachments 16 are aligned, a fastener, not shown, is inserted in the two attachments 16, attaching the floating bodies 14 together. A top surface 20 forms a portion of a floor 22 of the floating dock 10.

Figure 2:
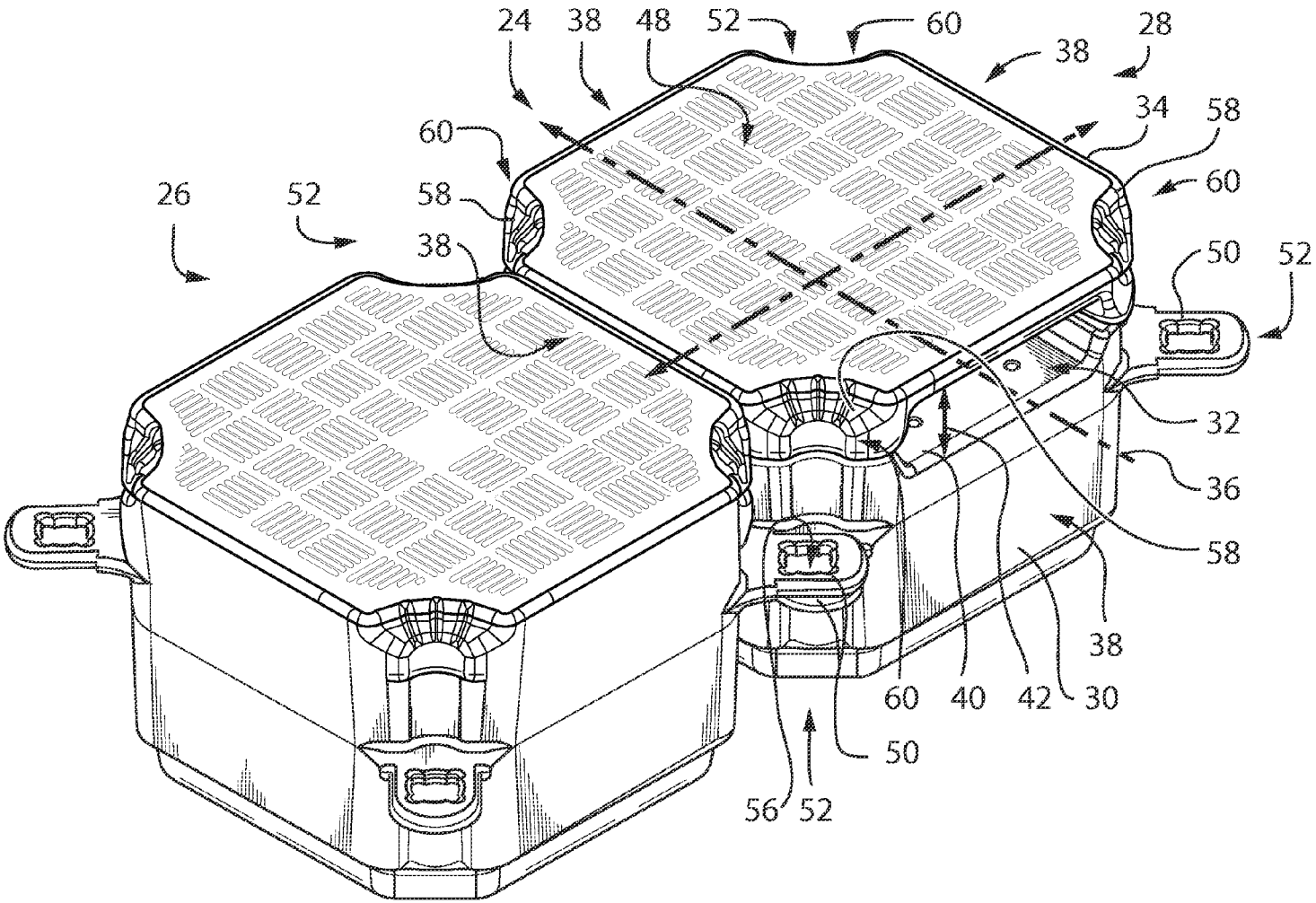
FIG. 2 is an axonometric view of a dock unit according to an embodiment of the invention, ready to be attached to a single piece dock unit according to the prior art.

Now referring to FIG. 2, there is shown a dock unit 24 according to an embodiment of the invention, adjacent to a single piece dock unit 26. The dock unit 24 is attachable to the single piece dock unit 26 through one or more attachments 50 using a fastener, not shown, for forming a floating dock 28 having a flat floor. Note that the dock unit 24 may similarly be attached to another dock unit 24.

The dock unit 24 comprises a floating body 30 having a mating surface 32, and a cover 34 for covering the mating surface 32. The floating body 30 and the cover 34 define a passage 36 there in between. The passage 36 may provide access to two, three or four lateral body sides 38 of the floating body 30. A recess 40 between four body corners 52 increases a height 42 of a portion of the passage 36 which allows running several networks of cables or piping therein.

The floating body 30 may comprise four attachments 50 located each at a different body corner 52 defined by the intersections of the four lateral body sides 38. Because the attachments 50 are staggered vertically, the single piece dock unit 26 and the dock unit 24 may be placed so that their adjacent attachments 50 overlap each other, thereby creating a threaded hole 56 for receiving the fastener, not shown.

The cover 34 further comprises four contact surfaces 58, each located at a different cover corner 60. Each contact surface 58 has a conical portion having a symmetry axis 62, best shown in FIG. 3 and now concurrently referred to, substantially normal to the top surface 48.

Figure 3:
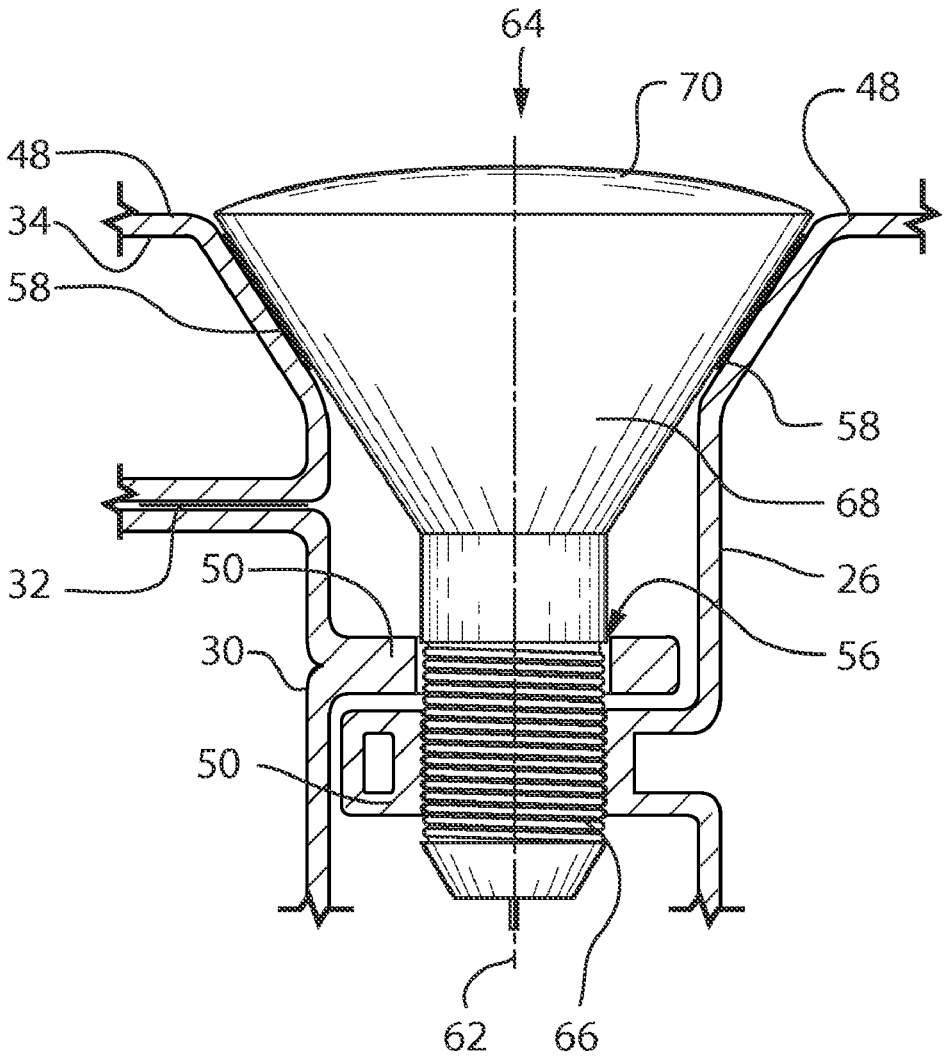
FIG. 3 is a cross-sectional side view of an assembly of the dock unit and the single piece dock unit of FIG. 2.

FIG. 3 shows a cross-sectional side view of a detail of the assembly of the floating body 30, the cover 34 and the single piece dock unit 26 with a fastener 64. The fastener 64 has threads 66, a conical head 68 and a fastener top 70. The contact surface 58, adapted to contact the conical head 68 of the fastener 64, is positioned proximate the attachments 50, so that as the fastener 64 engages the two adjacent attachments 50, it moves down according to the symmetry axis 62 until the conical head 68 contacts the conical portion of the contact surface 58 and squeezes it according to an horizontal force component and a vertical force component. The vertical force component squeezes the cover toward the mating surface 32 thereby limiting the movement of the cover 34 with respect to the floating body 30. When at least two diagonally opposite contact surfaces 58 are contacted by two fasteners 64, the horizontal force components horizontally locate and fix the cover 34 with respect to the floating body 30. With four fasteners 64, the cover 34 is firmly fixed to the floating body 30 at its periphery. Usually, edges of covers offer a hold allowing unexpected tears off or stripping. In this case, edges are hidden by the fasteners.

When the fastener 64 is screwed, the top surfaces 48 of all dock units and the fastener top 70 are substantially coplanar forming a portion of a floor, on which a person can walk without tripping. Moreover, water and other liquids poured on the top surface 48 directly flow to the edge of the cover 34 and down along the floating body 30, thereby reducing the risk of slippery areas.

FIG. 3 also shows that the attachments 50 are located vertically staggered so as to overlap and form the threaded hole 56 which receives the fastener 64 and thereby attaches the floating body 30 to the single piece dock unit 26. A person assembling the dock units 24, 26 must therefore mind the orientation of the dock units 24, 26 before attaching them.

Figure 4:
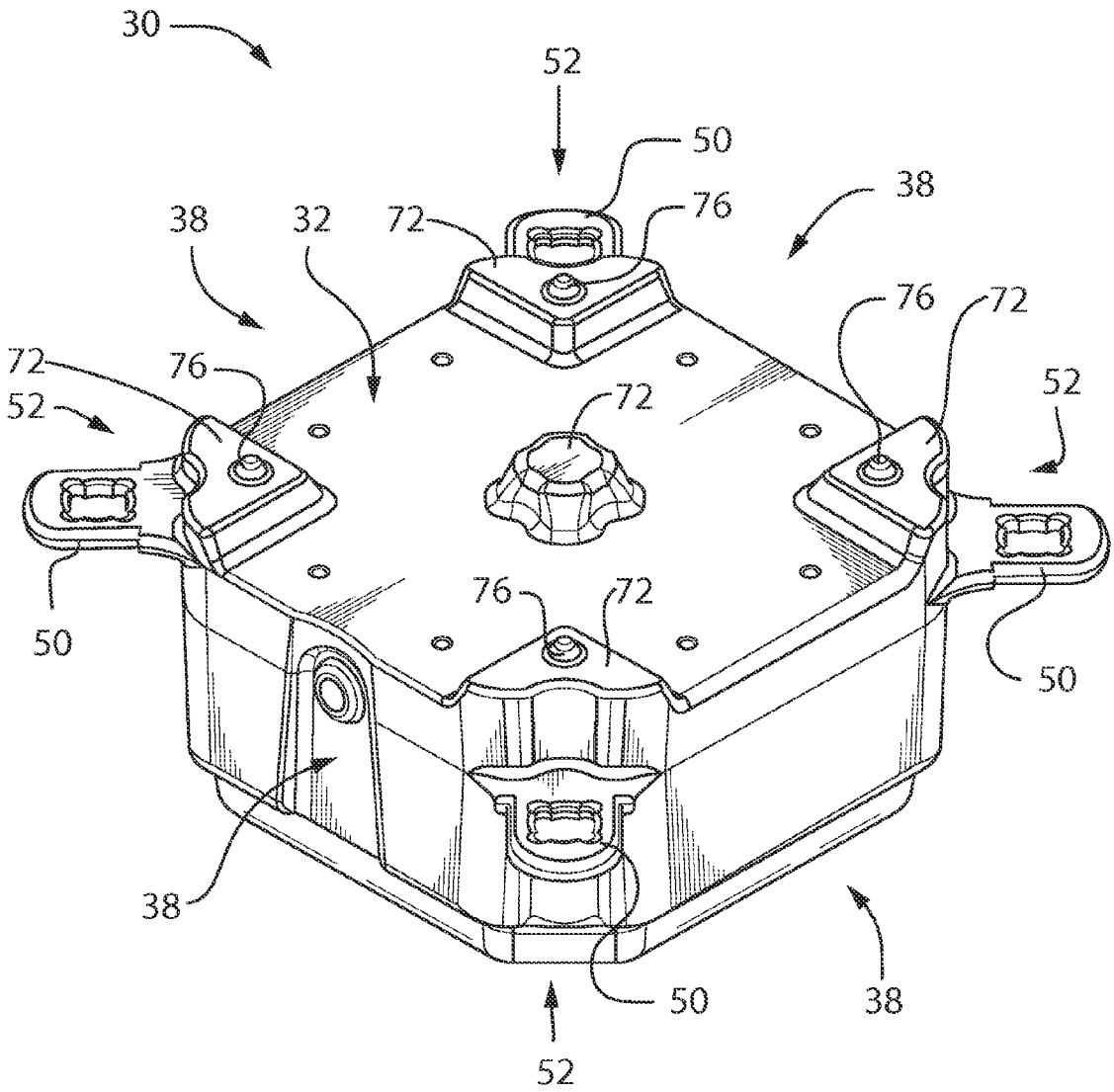
FIG. 4 is an axonometric view of a floating body included in the dock unit of FIG. 2.

Referring now to FIG. 4, there is shown the floating body 30 where the mating surface 32 further comprises five mating protuberances 72: four corner ones proximate to a different body corner 52 and a central one located substantially at the center of the mating surface 32. Each one of the four corner mating protuberances 72 comprises a locating boss 76.

Figure 5:
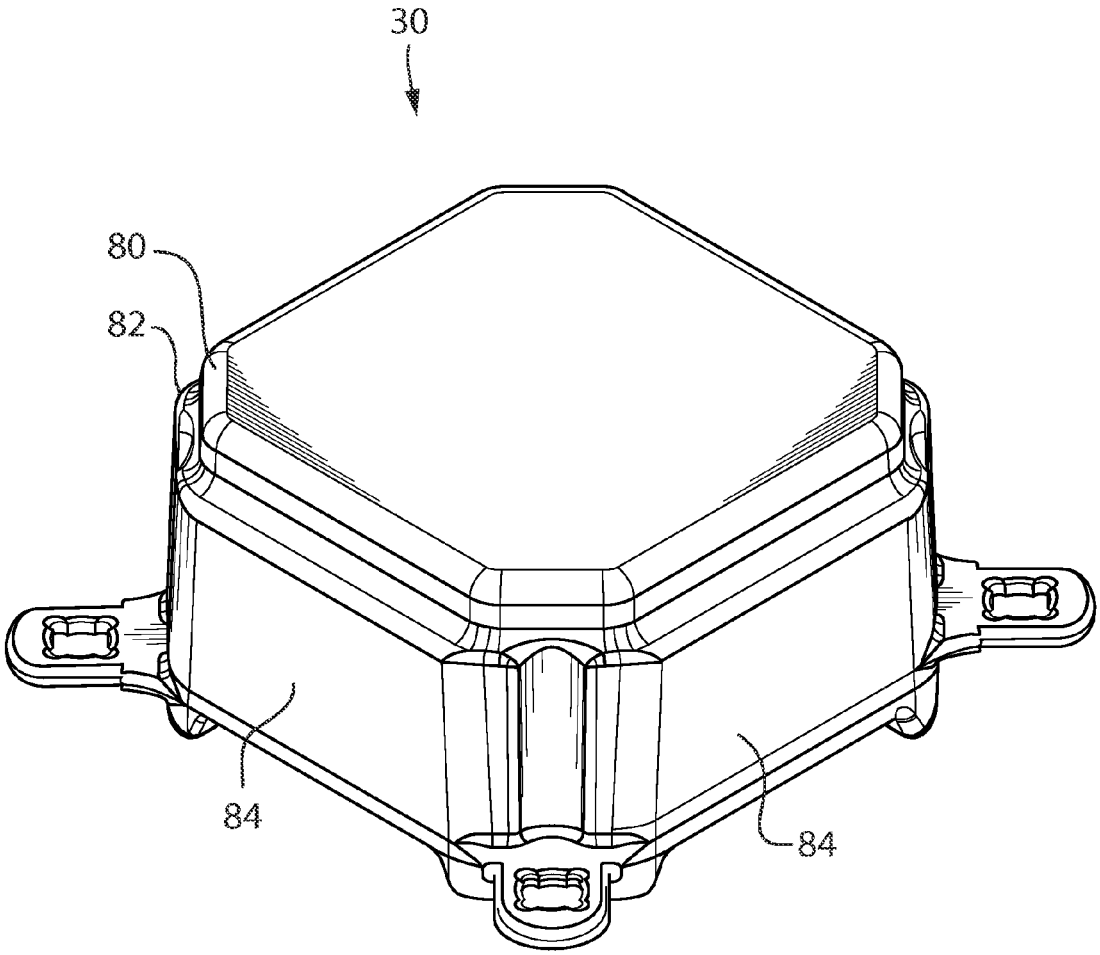
FIG. 5 is an axonometric view from the bottom of the floating body of FIG. 4.
Figure 6:
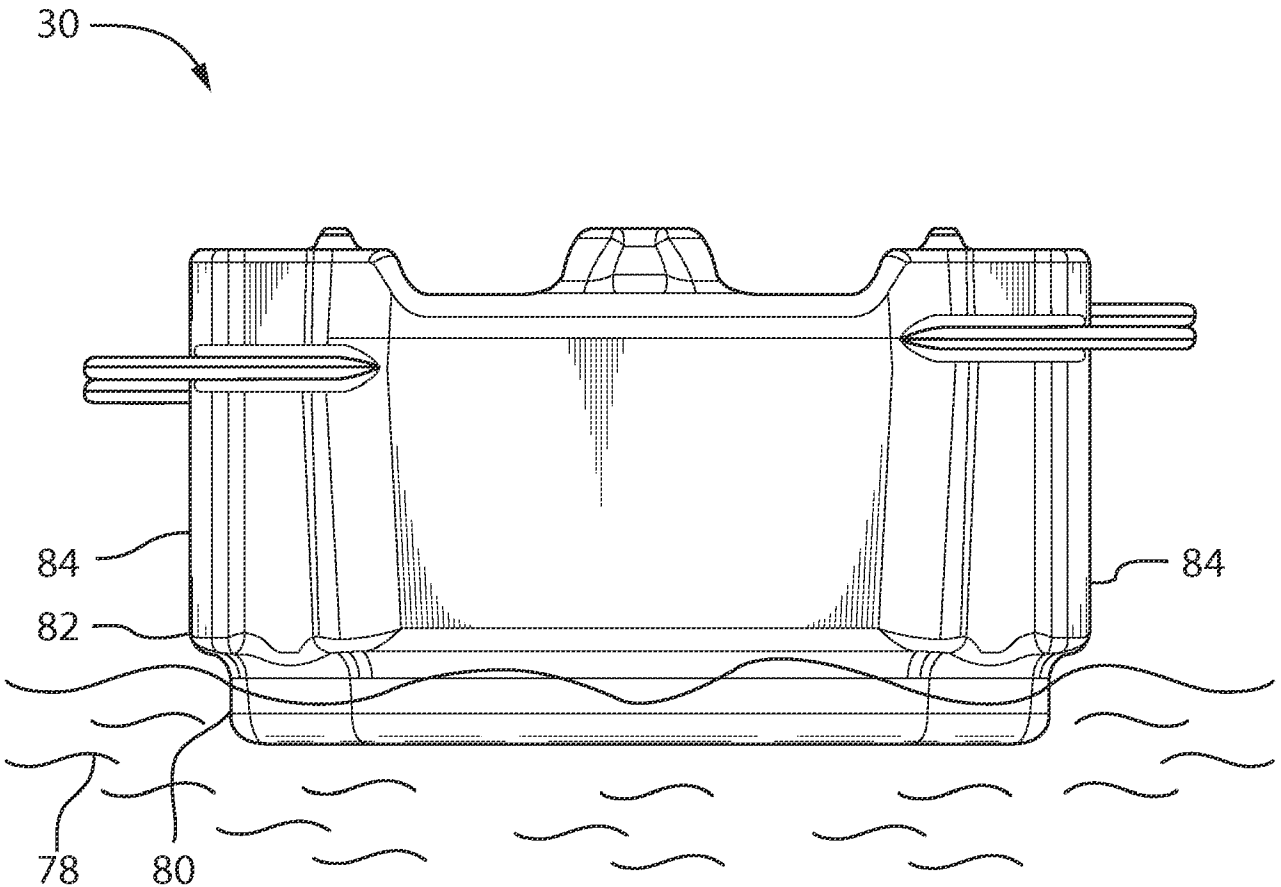
FIG. 6 is an elevation side view of the immersed floating body of FIG. 4.

Now concurrently referring to FIG. 5 and FIG. 6, there is shown the floating body 30 both from the bottom and in use in a liquid 78. The floating body 30 comprises a lower portion 80 immersed in the liquid 78 and an upper portion 82 adjacent to the lower portion 80. The lower portion 80 has a cross-section smaller than that of the upper portion 82 for preventing the liquid 78 from reaching and staining a lateral wall 84 of the upper portion 82.

Figure 7:
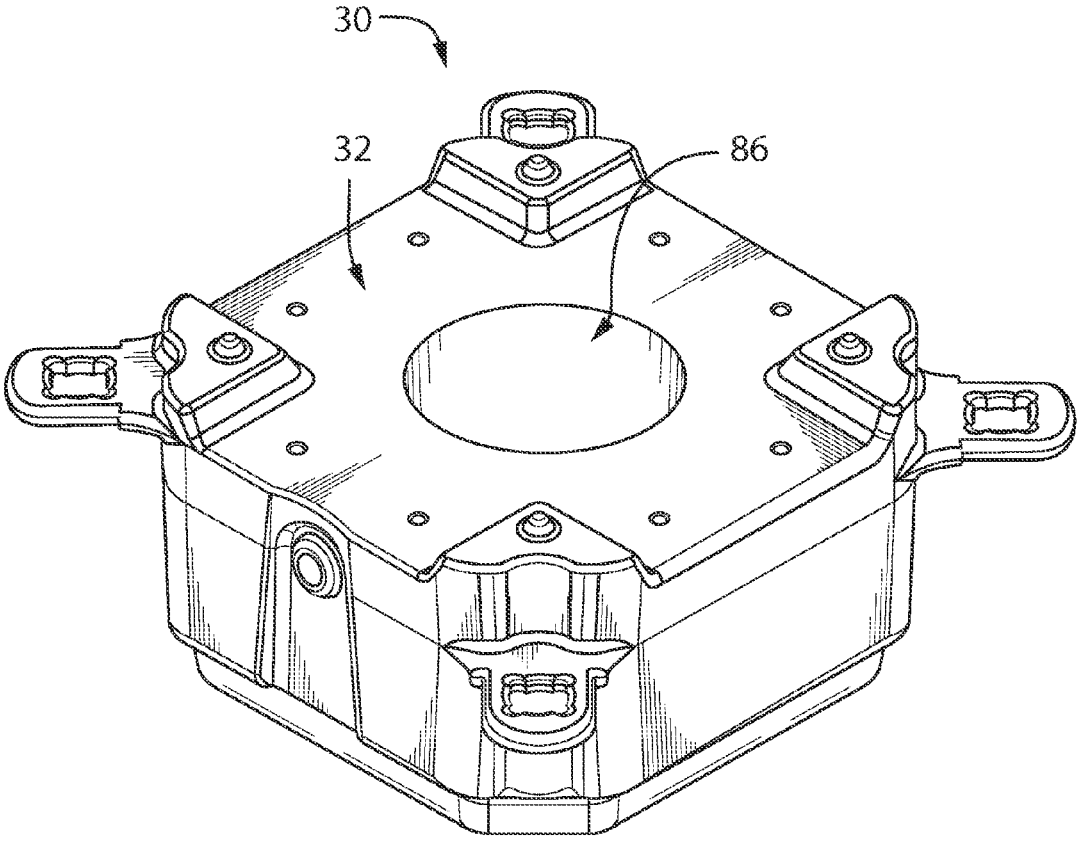
FIG. 7 is an axonometric view from the top of a floating body according to another embodiment of the invention.
Figure 8:
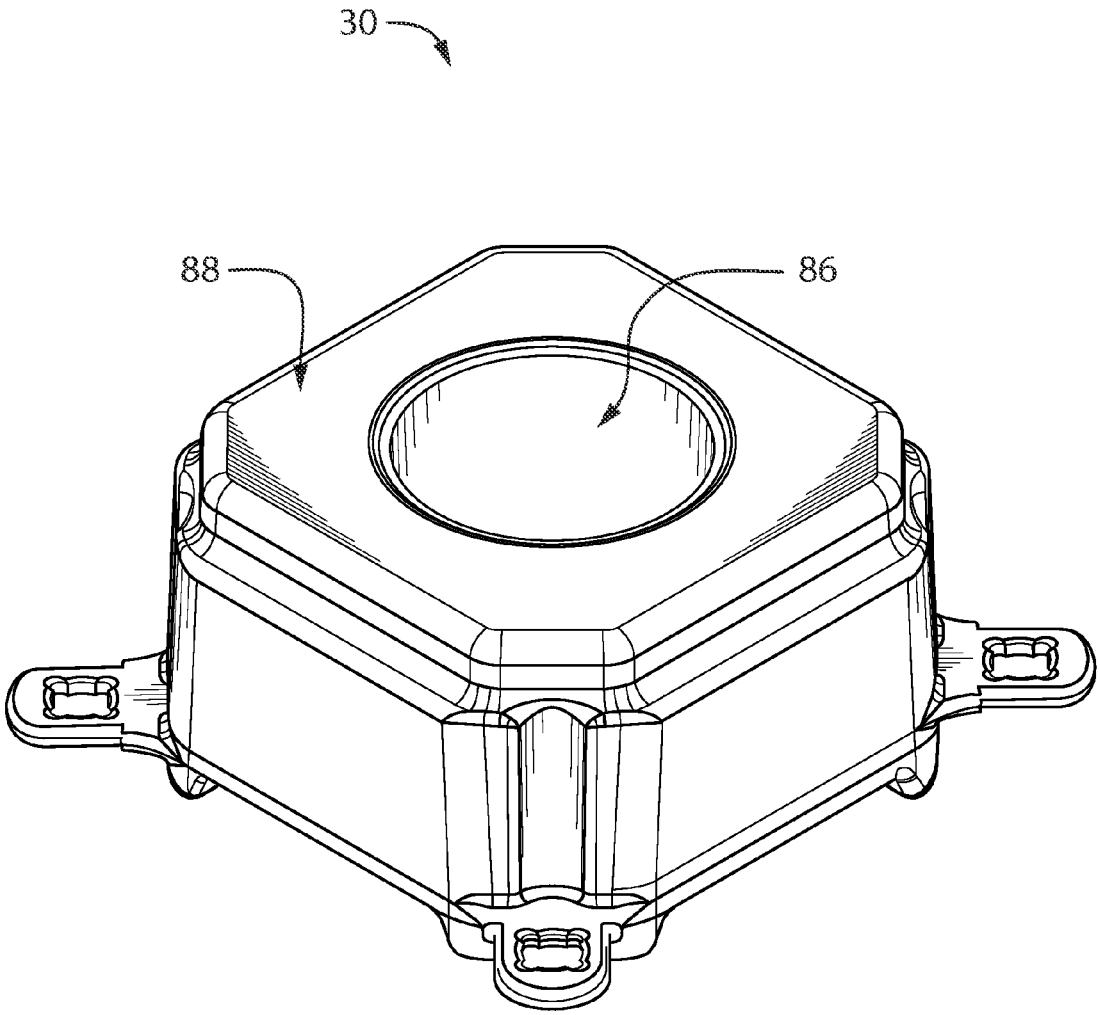
FIG. 8 is an axonometric view from the bottom of the floating body of FIG. 7.

Now concurrently referring to FIG. 7 and FIG. 8, there is shown the floating body 30 which optionally comprises a tunnel 86 through the floating body 30 and extending from the mating surface 32 to a bottom surface 88. The tunnel 86 allows light to pass through the floating body 30 and reach the liquid under the dock when combined with a transparent cover 34, as will be shown below.

A person skilled in the art could envision a floating body comprising a translucent portion such as a translucent insert, a portion made of translucent resin, a tunnel having any cross-section (such as oval, square, polygonal, etc) or a non-straight tunnel.

Figure 9:
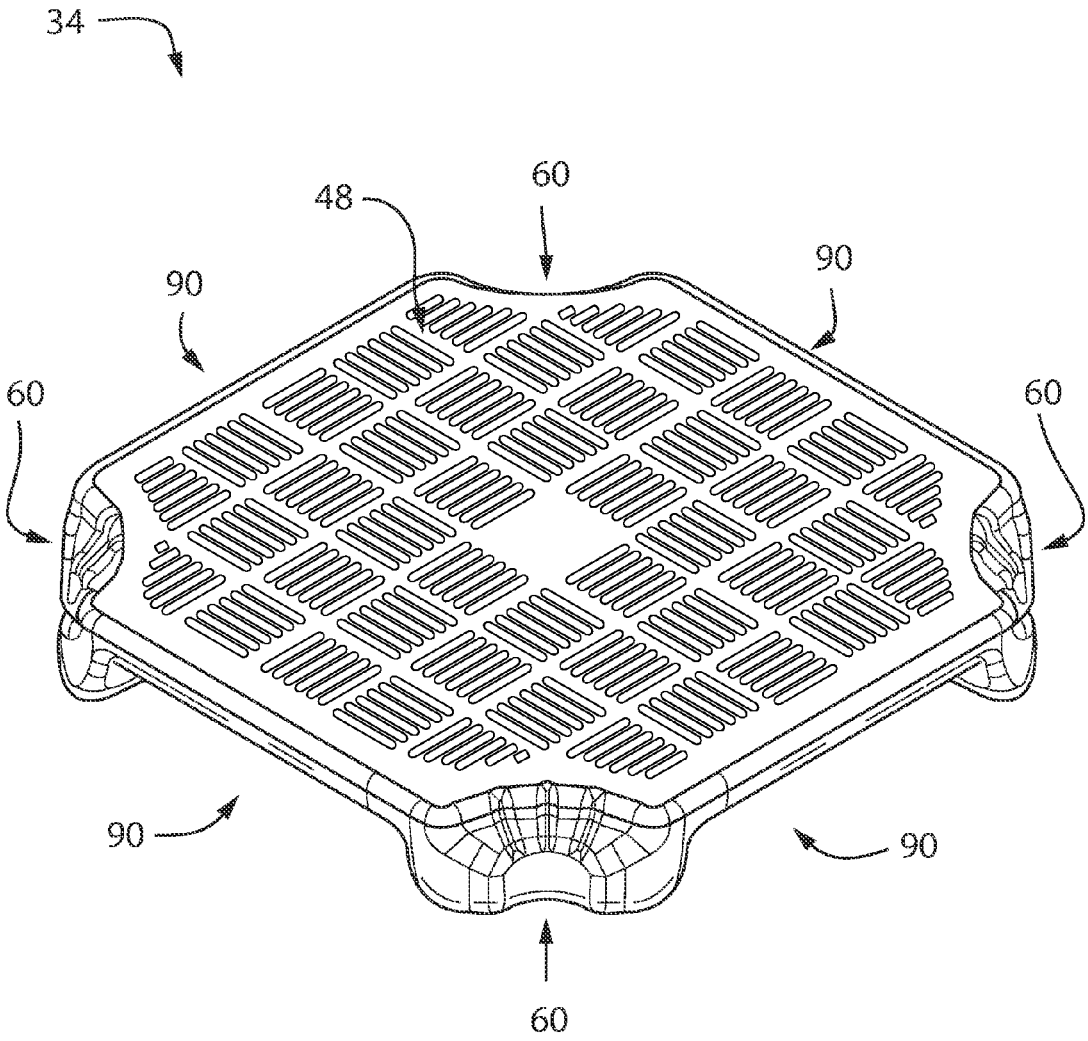
FIG. 9 is an axonometric view from the top of a cover included in the dock unit of FIG. 2.
Figure 10:
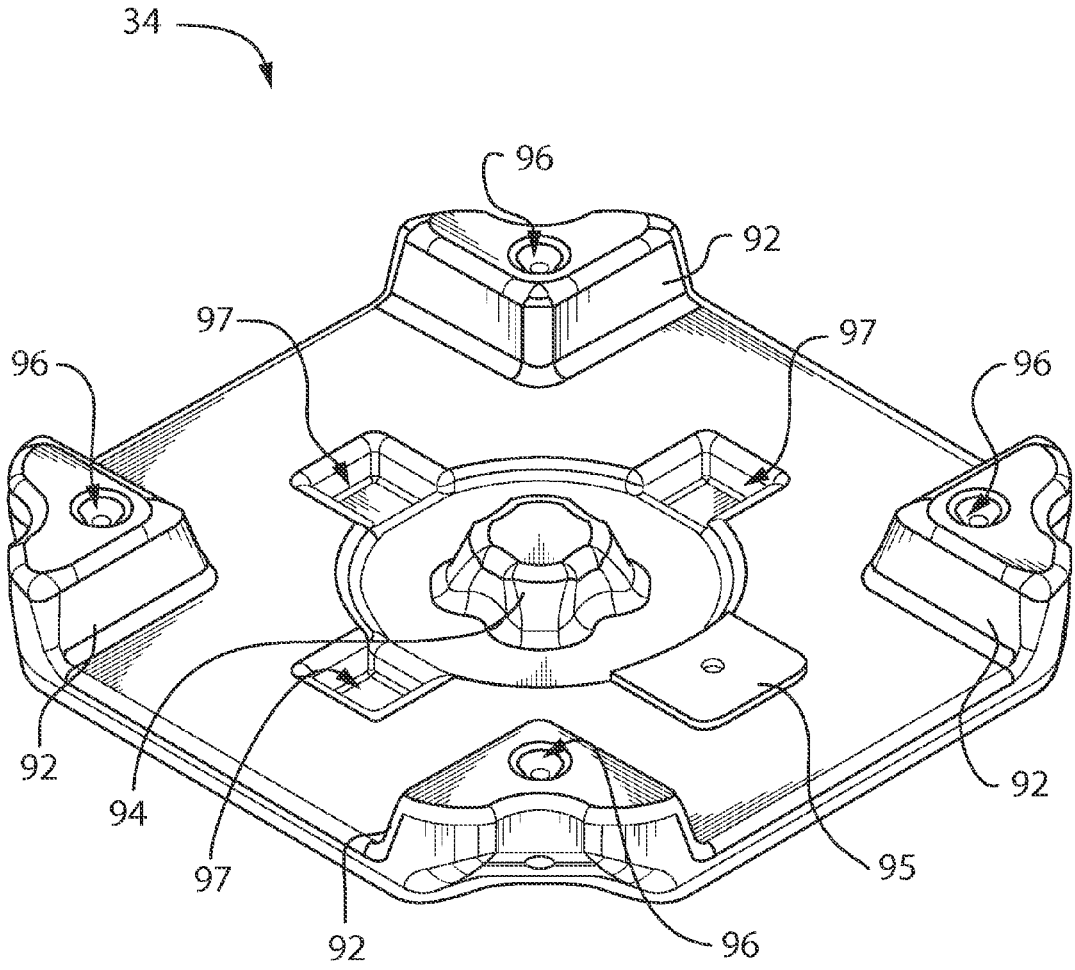
FIG. 10 is an axonometric view from the bottom of the cover of FIG. 9.

Now concurrently referring to FIG. 9 and FIG. 10, there is shown the cover 34 respectively from the top and from the bottom. The cover 34 comprises four lateral cover sides 90 defining the cover corners 60, four protrusions 92 located at a different cover corner 60 and a central protrusion 94 located substantially at the center of the cover 34. Each protrusion 92 comprises a cavity 96. Optionally, the cover 34 can receive a threaded insert 95 engaged in one of four cover recesses 97. The threaded insert 95, or any other convenient interface, can receive a bolt passing through the cover 34 for attaching an accessory on the top surface 48.

FIG. 2 and FIG. 4 are now concurrently referred to. The cover 34 is placed atop the floating body 30. The four protrusions 92 and the central protrusion 94 respectively abut against a different mating protuberance 72 for supporting the top surface 48 at a distance from the mating surface 32. Each locating boss 76 engages one different cavity 96, thereby acting as a positioning means and positioning the cover 34 with respect to the floating body 30.

In use, the load supported by the top surface 48 is spread over the five mating protuberance 72 via the four protrusions 92 and the center protrusion 94. In so doing, most of the load is applied on the periphery of the floating body 30, and more specifically at the body corners 52. At these locations, the floating body 30 is more resistant than at the center of the mating surface 32.

Figure 11:
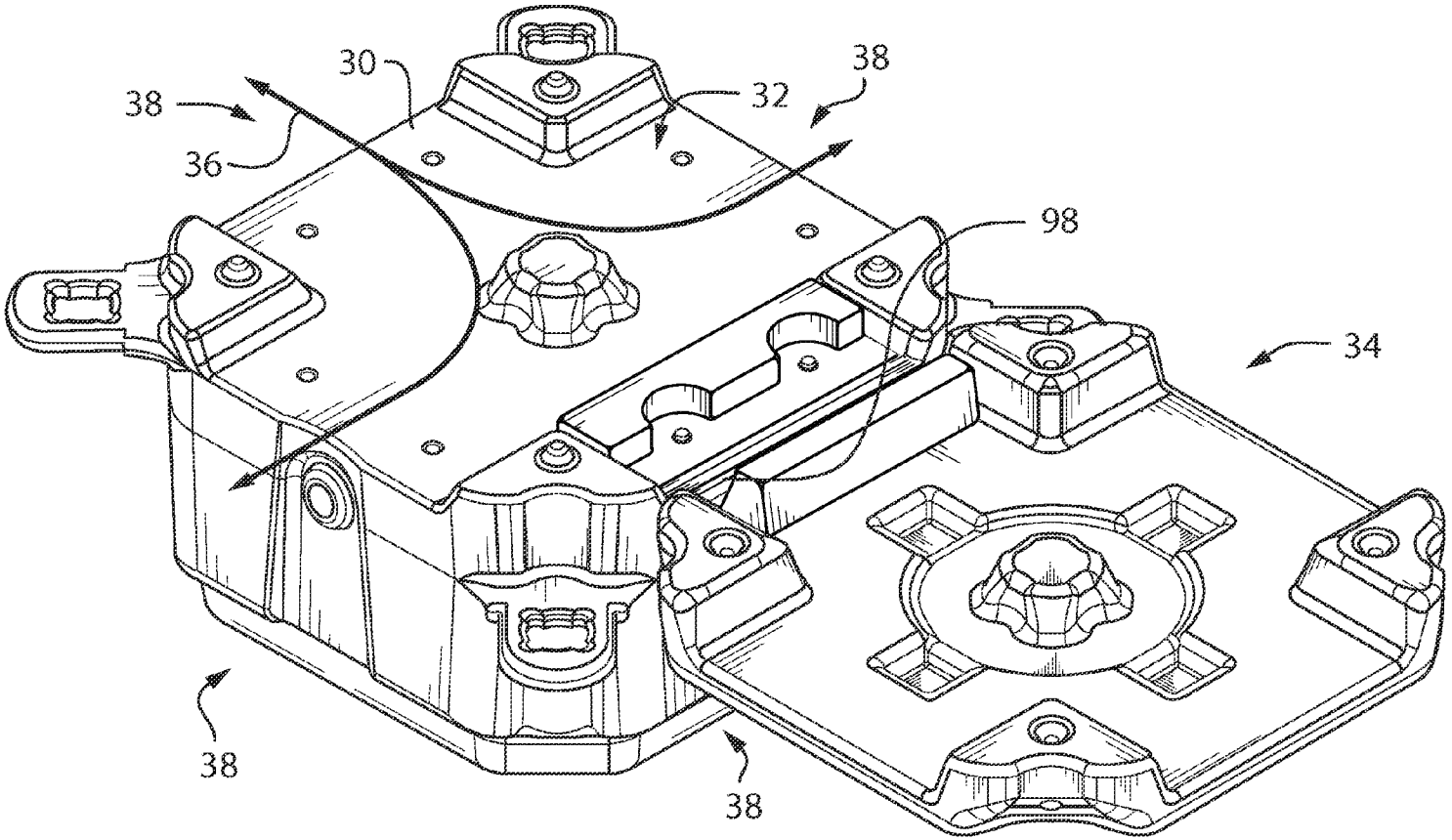
FIG. 11 is an axonometric view of a cover mounted to the floating body of FIG. 4 according to another embodiment of the invention.

Referring to FIG. 11 there is shown the cover 34 optionally comprising a hinge 98 attached to the floating body 30. The hinge 98 allows the cover 34 to pivot for covering the mating surface 32. This way, the hinge 98 closes one access to the passage 36 between the cover 34 and the floating body 30 from one lateral body side 38. This closing prevents non authorized people from modifying or deteriorating easily the installations and preventing birds or other animals to access this area.

Dock units equipped with a hinged cover are typically used on the side of the floating dock, the hinge facing the outside of the dock. Attachments of the sides of such docks don't receive the same fasteners than the fasteners 64 depicted on FIG. 3. Two fasteners received by the innermost attachments firmly fix the cover 34 to the floating body 30.

Figure 12:
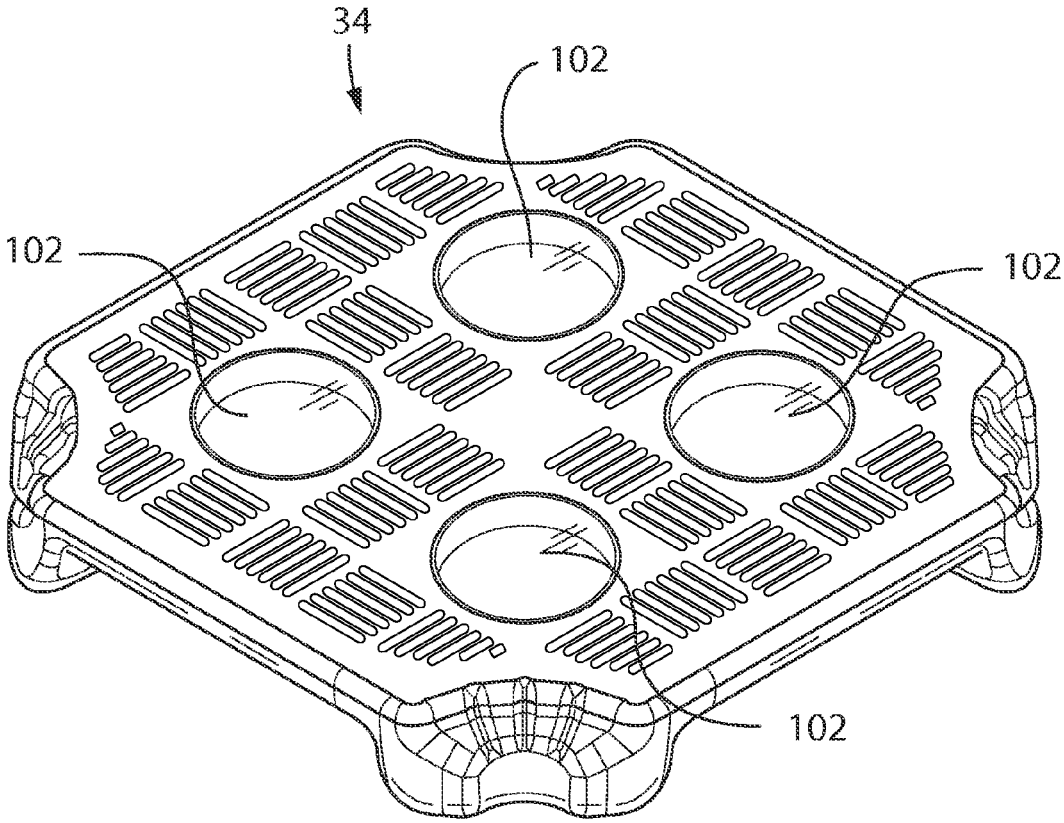
FIG. 12 is an axonometric view from the top of a cover according to another embodiment of the invention.

Referring to FIG. 12 there is shown the cover 34 optionally comprising four translucent portions 102 for permitting light to pass through the cover 34. Alternatively, the whole cover 34 could be completely made of a transparent material. Assembling such covers with the floating body 30 depicted on FIG. 7 and FIG. 8 forms a dock unit that allows the natural light to pass through the dock unit. Floating docks made of such dock units allow photosynthesis of plants to take place in the water under the floating dock.

Figure 13:
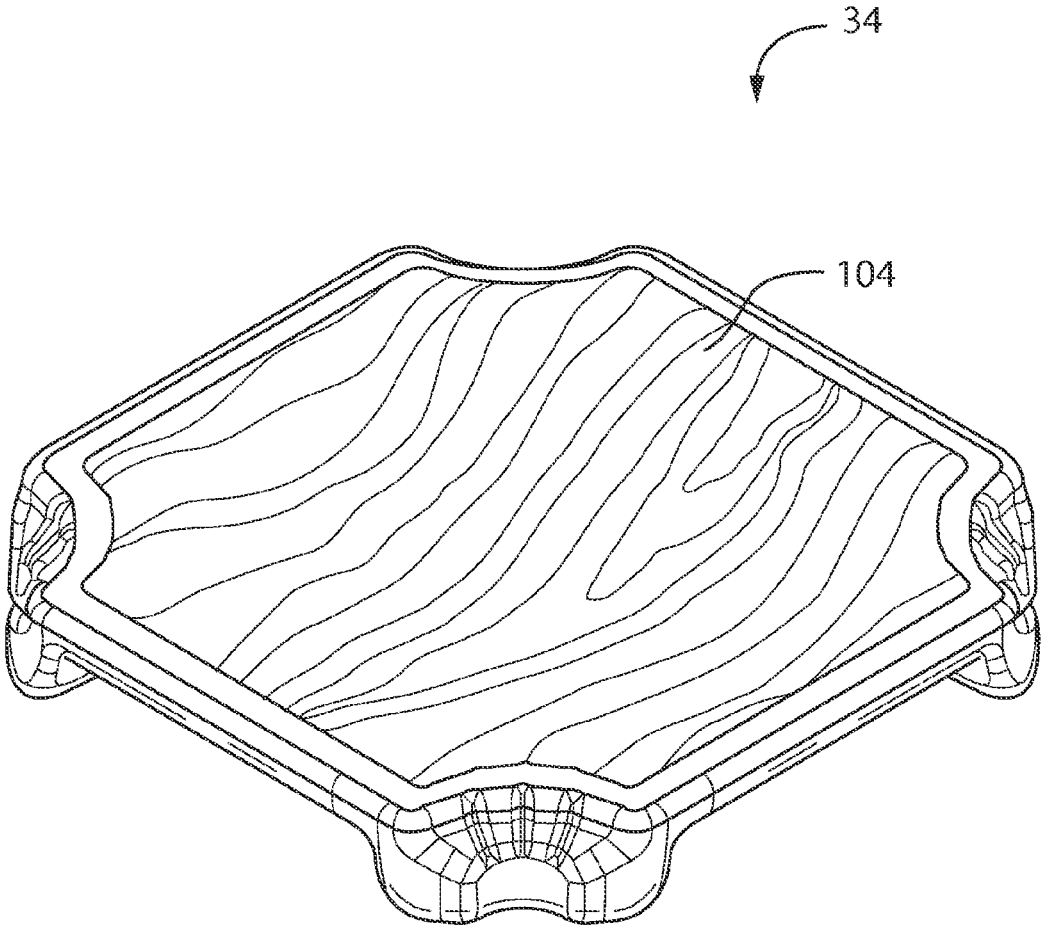
FIG. 13 is an axonometric view from the top of a cover according to another embodiment of the invention.

Referring to FIG. 13 there is shown the cover 34 optionally comprising a cover portion 104 made of wood for enhancing the aspect, the roughness or other such characteristics of the cover. A person skilled in the art may easily replace the wood with other materials such as concrete, glass, stone, glass fiber, carbon fiber, aluminum, and plastic depending on expected specific characteristic. These characteristics could be a resistance to ultraviolet, a resistance to salt, a specific flexibility, an aspect, a thermal resistance, a heat capacity etc.

Figure 14:
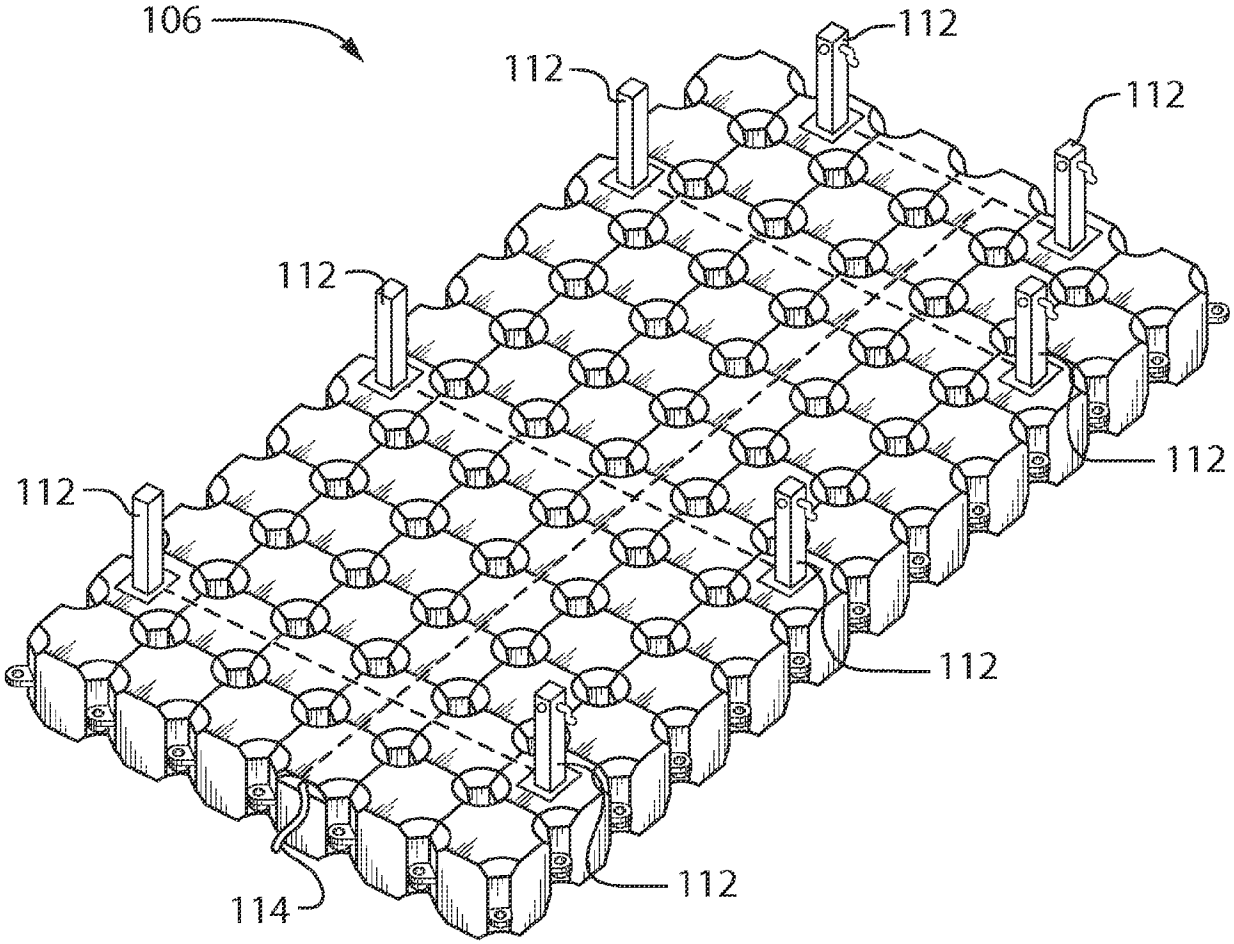
FIG. 14 is an axonometric view of a floating dock partially made with the floating bodies of FIG. 4, and the covers of FIG. 9.
Figure 15:
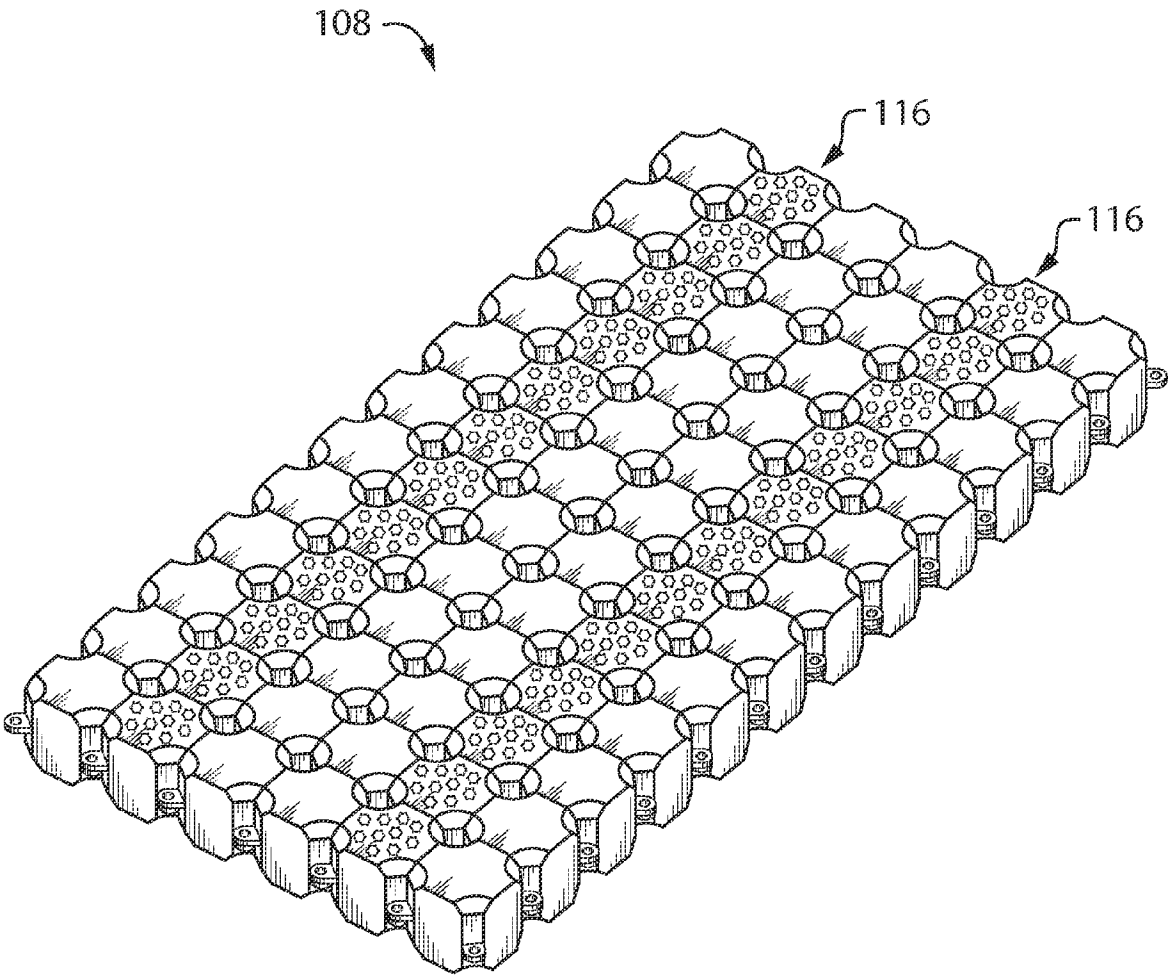
FIG. 15 is an axonometric view of a floating dock partially made with the floating bodies of FIG. 4 according to another embodiment of the invention.
Figure 16:
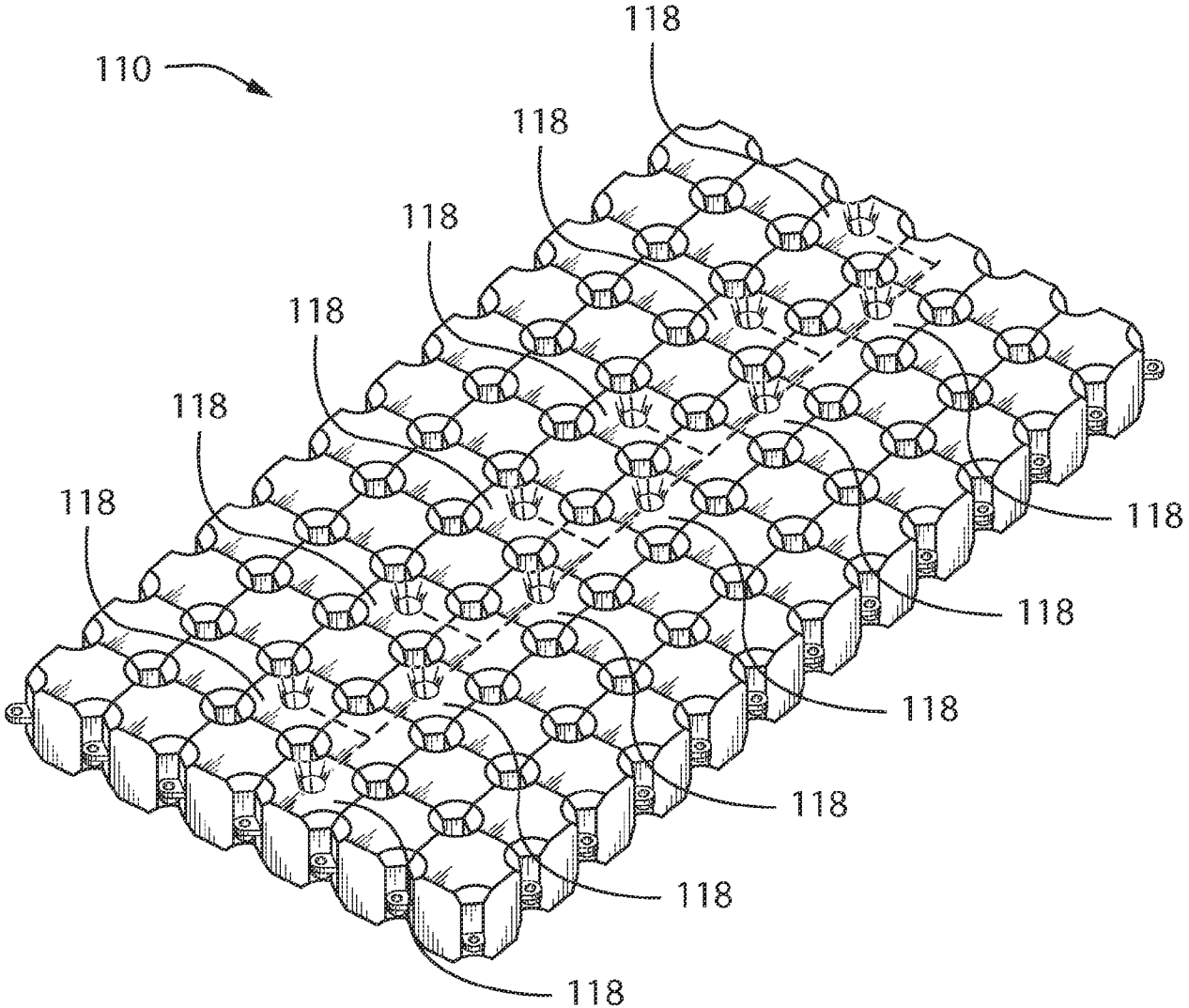
FIG. 16 is an axonometric view of a floating dock partially made with the floating bodies of FIG. 4 according to another embodiment of the invention.

Turning to FIG. 14, FIG. 15 and FIG. 16, there are shown examples of floating docks 106, 108, 110 assembled with dock units designed according to the invention. The floating dock 106 comprises eight service bases 112 for delivering water and electricity, the corresponding networks passing under the covers. Water and electricity are provided by a central piping and cables 114.

The floating dock 108 comprises two tracks 116 of dock units each having a cover having a rigid and rough top surface. The two tracks 116 form a running surface for vehicles. Such running surfaces prevent vehicles from slipping off the tracks 116.

The floating dock 110 comprises several dock units having a cover 118 including a translucent portion. The floating dock 110 further comprises a lighting network under the covers 118 for passing through the translucent portions of the translucent covers 118. These lights could be useful to locate the floor of the floating dock 110 in the night or to indicate a landing area for helicopters.

It is understood that a person skilled in the art could envision different embodiment of this invention. For example, the floating body may comprise three or more sides and three or more attachments located at any convenient places on the periphery of the floating body.

Moreover, the shape of the bottom of the cover 34 could include reinforcements such as arches for increasing the rigidity of the top surface 48.

It is understood that the cover 34 could do without center protrusion 94 for freeing the passage 36. Conversely, for a specific purpose, it could be envisioned that the cover 34 could do without the four protrusions 92 and use only the center protrusion 94 for abutting against the mating center 72 for supporting the top surface 48 at a distance from the mating surface 32.

While preferred embodiments of the invention have been described above and illustrated in the accompanying drawings, it will be evident to those skilled in the art that modifications may be made therein without departing from the essence of this invention. Such modifications are considered as possible variants comprised in the scope of the invention.

The invention claimed is:

1. A dock unit attachable to another dock unit with a fastener for forming a floating dock, the dock unit comprising:

a floating body having a mating surface and an attachment adapted to receive the fastener and thereby attaching the floating body to the other dock unit; and a cover for covering the mating surface, the cover having a contact surface adapted to contact the fastener;

wherein, in use, the contact surface is positioned proximate the attachment so that, when the attachment receives the fastener, the contact surface is contacted by the fastener, thereby limiting the movement of the cover with respect to the floating body.

2. The dock unit of claim 1 wherein the floating body has four lateral body sides, the floating body and the cover defining a passage there in between, the passage providing access to at least two of the four lateral body sides.

3. The dock unit of claim 1, wherein the floating body has four lateral body sides and four attachments, each one of the four attachments being associated with at least one of the four lateral body sides, the cover further having four contact surfaces, each one of the four contact surfaces being positioned proximate a different one of the four attachments so that, when each one of the four attachments receives a respective fastener, each one of the four contact surfaces is contacted by its respective fastener, thereby fixing the cover with respect to the floating body.

4. The dock unit of claim 3, wherein the intersections of the four lateral body sides define four body corners, each one of the four attachments being located at a different one of the four body corners.

5. The dock unit of claim 1, wherein the contact surface comprises a conical portion having a symmetry axis substantially normal to the mating surface when the dock unit is in use.

6. The dock unit of claim 1, further comprising a positioning means for positioning the cover with respect to the floating body.

7. The dock unit of claim 1, further comprising a hinge for connecting the cover to the floating body.

8. The dock unit of claim 1, wherein the cover comprises a translucent portion for permitting light to pass through the cover.

9. The dock unit of claim 8, wherein the floating body further comprises a translucent portion for permitting light to pass through the floating body.

10. The dock unit of claim 8, wherein the floating body further comprises a tunnel through the floating body extending from the mating surface to a bottom surface.

11. The dock unit of claim 1, wherein the cover comprises a portion made of a material selected from the group consisting of wood, concrete, glass, stone, glass fiber, carbon fiber, aluminum, and plastic.

12. The dock unit of claim 1, wherein the cover further comprises an interface for fixing accessories on a top surface of the cover.

13. The dock unit of claim 1, wherein the floating body further comprises a lower portion for being immersed in a liquid and an upper portion adjacent to the lower portion, the upper portion having an upper cross-section and the lower portion having a lower cross-section substantially smaller than the upper cross-section for preventing a liquid from reaching a lateral wall of the upper portion.

14. A floating dock comprising a plurality of dock units as defined in claim 1 and a plurality of fasteners, each one of the plurality of dock units being attached to at least one other of the plurality of dock units with one of the plurality of fasteners, thereby defining a pair of corresponding floating bodies and a pair of corresponding covers attached by the one of the plurality of fasteners.

15. A dock unit for a floating dock, the dock unit comprising:

a floating body having a mating surface and at least three lateral body sides; and a cover for covering the mating surface, the cover having a top surface for forming a floor for the floating dock, the cover having at least three protrusions for abutting against the mating surface and for supporting the top surface at a distance from the mating surface; thereby creating a passage between the top surface and the mating surface providing access to each of the three lateral body sides.

16. The dock unit of claim 15, wherein the floating dock comprises four lateral body sides defining four body corners and wherein the cover further has four protrusions, each one of the four protrusions for abutting against the mating surface proximate a different one of the four body corners.

17. The dock unit of claim 15, wherein the mating surface comprises a recess for increasing a height of a portion of the passage.

18. A dock unit for a floating dock, the dock unit comprising:

a floating body having a mating surface and at least three lateral body sides; and a cover for covering the mating surface, the cover having a top surface for forming a floor for the floating dock, the cover having a protrusion for abutting against the mating surface and for supporting the top surface at a distance from the mating surface; thereby creating a passage between the top surface and the mating surface providing access to each of the three lateral body sides wherein the protrusion is substantially located in a center of the cover.

19. A cover for covering a mating surface of a floating body assembled to another floating body with a fastener for forming a floating dock, the cover comprising:

four lateral cover sides defining four cover corners;

a top surface for forming the floor of the floating dock;

four protrusions, each one of the four protrusions being operative to abut against the floating body for supporting the top surface at a distance from the floating body, each one of the four protrusions being located at a different one of the four cover corners thereby creating a passage between the top surface and the floating body providing access to at least two of the four lateral cover sides; and four contact surfaces, each one of the four contact surfaces comprising a conical portion having a symmetry axis substantially normal to the top surface, each one of the four contact surfaces being located at a different one of the four cover corners so that when the fastener attaches the floating body to the other floating body, one of the four contact surfaces is contacted by the fastener, thereby limiting the movement of the cover with respect to the floating body.

20. A kit for a floating dock comprising:

a plurality of fasteners;

a plurality of floating bodies, each one of the plurality of floating bodies having a mating surface, four lateral body sides defining four body corners and four attachments, each one of the four attachments being located at a different one of the four body corners and being adapted to receive one of the plurality of fasteners thereby attaching each one of the plurality of floating bodies to another one of the plurality of floating bodies; and a cover for covering the mating surface, the cover having a top surface for forming a floor for the floating dock, the cover further having at least three protrusions, each one of the at least three protrusions for abutting against the mating surface proximate a different one of the four body corners, and for supporting the top surface at a distance from the mating surface; thereby creating a passage between the top surface and the mating surface providing access to each of the four lateral body sides.

* * * * *